US007472507B2

(12) United States Patent
Curry et al.

(10) Patent No.: US 7,472,507 B2
(45) Date of Patent: Jan. 6, 2009

(54) FIREARM WITH MODULAR SEAR AND TRIGGER MECHANISM HOUSINGS

(75) Inventors: Brett Curry, Chicopee, MA (US); Michael J. Poulin, Granby, MA (US)

(73) Assignee: Smith & Wesson Corp., Springfield, MA (US)

( * ) Notice: Subject to any disclaimer, the term of this patent is extended or adjusted under 35 U.S.C. 154(b) by 164 days.

(21) Appl. No.: 11/315,477

(22) Filed: Dec. 22, 2005

(65) Prior Publication Data

US 2006/0156607 A1 Jul. 20, 2006

Related U.S. Application Data

(60) Provisional application No. 60/639,187, filed on Dec. 22, 2004, provisional application No. 60/638,753, filed on Dec. 22, 2004, provisional application No. 60/638,752, filed on Dec. 22, 2004, provisional application No. 60/638,751, filed on Dec. 22, 2004, provisional application No. 60/638,746, filed on Dec. 22, 2004, provisional application No. 60/638,594, filed on Dec. 22, 2004, provisional application No. 60/638,593, filed on Dec. 22, 2004, provisional application No. 60/638,592, filed on Dec. 22, 2004.

(51) Int. Cl.
*F41A 3/12* (2006.01)
*F41A 19/06* (2006.01)

(52) U.S. Cl. ..... 42/69.01; 42/14; 42/71.02; 89/196

(58) Field of Classification Search ..... 42/69.01, 42/71.01, 71.02, 75.01, 10, 14, 16, 16.1, 42/23; 89/196

See application file for complete search history.

(56) References Cited

U.S. PATENT DOCUMENTS

| | | | | |
|---|---|---|---|---|
| 802,582 | A * | 10/1905 | Mueller | 89/144 |
| 4,011,678 | A | 3/1977 | Brodbeck et al. | |
| 4,031,648 | A | 6/1977 | Thomas | |
| 4,522,105 | A | 6/1985 | Atchisson | |
| 4,539,889 | A | 9/1985 | Glock | |
| 4,825,744 | A | 5/1989 | Glock | |
| 4,893,546 | A | 1/1990 | Glock | |
| 4,967,724 | A | 11/1990 | Senfter | |
| 5,012,604 | A | 5/1991 | Rogers | |
| 5,018,292 | A | 5/1991 | West | |
| 5,024,139 | A | 6/1991 | Knight, Jr. et al. | |
| 5,036,612 | A | 8/1991 | Jennings | |
| 5,050,480 | A | 9/1991 | Knight, Jr. et al. | |

(Continued)

*Primary Examiner*—Bret Hayes
(74) *Attorney, Agent, or Firm*—McCormick, Paulding & Huber LLP

(57) ABSTRACT

A firearm includes a frame, a slide, and modular sear and trigger mechanism housings. The frame has fore and rear receptacles integrally formed therein, e.g., upwardly open compartments accessible from the top of the frame. The modular housings house one or more operational components of the firearm, e.g., trigger and sear components, and are configured for "drop in" insertion into the receptacles. Each housing also includes a set of integral slide rails. For assembly, the operational components are attached to the modular housings, and the housings are dropped into the receptacles and secured to the frame. The slide is operably positioned on the slide rails for reciprocating movement thereon. The frame is provided without integral rails and other features for supporting the operational components. Instead, the rails are provided as part of the modular, drop-in sear and trigger mechanism housings, which also support the operational components.

13 Claims, 4 Drawing Sheets

U.S. PATENT DOCUMENTS 5,050,481 A 9/1991 Knight, Jr. et al.
5,081,780 A 1/1992 Lishness et al.
5,086,578 A 2/1992 Lishness et al.
5,086,579 A 2/1992 Flatley et al.
5,088,222 A 2/1992 Larson
5,090,147 A 2/1992 Pastor
5,105,569 A * 4/1992 Straitiff ..... 42/2
5,105,570 A 4/1992 Lishness et al.
5,115,588 A 5/1992 Bronsart et al.
5,119,634 A 6/1992 Berry et al.
5,149,898 A 9/1992 Chesnut et al.
5,157,209 A 10/1992 Dunn
5,160,796 A 11/1992 Tuma et al.
5,164,534 A 11/1992 Royster
5,166,458 A 11/1992 Yoo
5,187,312 A 2/1993 Osborne
5,195,226 A 3/1993 Bornancini
5,216,191 A 6/1993 Fox
5,216,195 A 6/1993 Tuma
5,225,612 A 7/1993 Bernkrant
5,235,770 A 8/1993 Simon et al.
5,241,769 A 9/1993 Von Muller
5,247,757 A 9/1993 Deeb
5,251,394 A 10/1993 Bornancini
5,267,407 A 12/1993 Bornancini
5,272,957 A 12/1993 Chesnut et al.
5,299,374 A 4/1994 Mathys
5,303,494 A 4/1994 Tuma et al.
5,327,810 A 7/1994 Sandusky et al.
5,349,939 A 9/1994 Perrone
5,355,768 A 10/1994 Felk
5,373,775 A 12/1994 Findlay, Sr. et al.
5,386,659 A 2/1995 Vaid et al.
5,388,362 A 2/1995 Melcher
5,400,537 A 3/1995 Meller et al.
5,412,894 A 5/1995 Moon
5,417,001 A 5/1995 Rousseau
5,426,881 A 6/1995 Ruger
5,438,784 A 8/1995 Lenkarski et al.
5,448,939 A 9/1995 Findlay, Sr. et al.
5,454,182 A * 10/1995 Lewis et al. ..... 42/51
5,487,233 A 1/1996 Jewell, Arnold W.
5,493,806 A 2/1996 Langevin et al.
5,502,914 A 4/1996 Moon
5,517,896 A 5/1996 Perrine
5,548,914 A 8/1996 Anderson
5,570,527 A 11/1996 Felicci
5,581,927 A 12/1996 Meller
5,604,326 A 2/1997 Lescure
5,606,825 A 3/1997 Olsen
5,615,507 A 4/1997 French
5,623,114 A 4/1997 Soper
5,625,971 A 5/1997 Tuma et al.
5,634,456 A 6/1997 Perrone
5,635,664 A 6/1997 Pons et al.
5,640,794 A 6/1997 Gardner et al.
5,655,326 A 8/1997 Levavi et al.
5,669,169 A * 9/1997 Schmitter et al. ..... 42/75.01
5,680,722 A 10/1997 French et al.
5,697,178 A 12/1997 Haskell
5,701,698 A 12/1997 Wesp et al.
5,709,046 A 1/1998 Canaday
5,711,286 A 1/1998 Petrosyan et al.
5,713,150 A 2/1998 Ealovega
5,717,156 A 2/1998 Lenkarski
5,718,074 A 2/1998 Keeney
5,736,667 A 4/1998 Munostes et al.
5,741,996 A * 4/1998 Ruger et al. ..... 89/196
5,760,328 A 6/1998 Robbins
5,770,814 A 6/1998 Ealovega
5,778,585 A 7/1998 Sigg
5,797,206 A 8/1998 Vitorino
5,806,225 A 9/1998 Gardner et al.
5,815,973 A 10/1998 Hochstrate
5,826,362 A 10/1998 Lyons
5,834,678 A 11/1998 Kalb
5,852,891 A 12/1998 Onishi et al.
5,857,280 A 1/1999 Jewell
5,906,066 A 5/1999 Felk
5,913,261 A 6/1999 Guhring et al.
5,974,717 A 11/1999 Brooks
5,987,796 A 11/1999 Brooks
6,000,162 A 12/1999 Hochstrate
6,070,512 A 6/2000 Rohrbaugh
6,125,735 A 10/2000 Guhring
6,131,324 A 10/2000 Jewell
6,164,001 A 12/2000 Lee
6,205,694 B1 3/2001 Davis, Sr.
6,240,669 B1 6/2001 Spaniel et al.
6,253,479 B1 7/2001 Fuchs et al.
6,256,918 B1 7/2001 Szabo
6,256,920 B1 7/2001 Olson
6,263,607 B1 7/2001 Fuchs et al.
6,266,909 B1 7/2001 Fuchs et al.
6,272,783 B1 8/2001 Dumortier et al.
6,289,619 B1 9/2001 Fuchs et al.
6,293,039 B1 9/2001 Fuchs
6,341,442 B1 1/2002 Szabo et al.
6,354,032 B1 3/2002 Viani
6,367,186 B1 4/2002 Gibala
6,381,892 B1 5/2002 Szabo et al.
6,382,200 B1 5/2002 Levkov
6,405,631 B1 6/2002 Milek
6,412,206 B1 7/2002 Strayer
6,415,702 B1 7/2002 Szabo et al.
6,425,199 B1 7/2002 Vaid et al.
6,513,273 B2 2/2003 da Silveira
6,519,887 B1 2/2003 Allen et al.
6,539,658 B1 4/2003 Hubert et al.
6,543,169 B2 4/2003 Bero
6,553,706 B1 4/2003 Gancarz et al.
6,557,288 B2 5/2003 Szabo
6,560,909 B2 5/2003 Cominolli
6,588,136 B2 7/2003 Baker et al.
6,601,331 B2 8/2003 Salvitti
6,615,527 B1 9/2003 Martin
6,640,478 B2 11/2003 Johansson
6,643,968 B2 11/2003 Glock
6,655,066 B2 12/2003 Fluhr
6,665,973 B1 12/2003 Peev
6,688,210 B2 2/2004 Bubits
6,705,036 B2 3/2004 Orr
6,711,842 B1 3/2004 Chapman
6,718,680 B2 4/2004 Roca et al.
6,732,464 B2 5/2004 Kurvinen
6,735,897 B1 5/2004 Schmitter et al.
6,769,208 B2 8/2004 Beretta
6,789,342 B2 9/2004 Wonisch et al.
6,957,644 B2 * 10/2005 Simo et al. ..... 124/35.2

* cited by examiner

FIREARM WITH MODULAR SEAR AND TRIGGER MECHANISM HOUSINGS

This application claims the benefit of the following U.S. Provisional Applications: Ser. No. 60/639,187; Ser. No. 60/638,594; Ser. No. 60/638,753; Ser. No. 60/638,593; Ser. No. 60/638,746; Ser. No. 60/638,592;Ser. No. 60/638,751; and Ser. No. 60/638,752, all filed Dec. 22, 2004, and all hereby incorporated by reference herein in their entireties.

FIELD OF THE INVENTION

The present invention relates to firearms, and, more particularly, to firearm frames and frame components.

BACKGROUND OF THE INVENTION

Most semiautomatic handguns include a frame and a slide that moves along the firearm's longitudinal firing axis in a reciprocating manner. The frame provides the core support structure for the firearm's operational and other components, e.g., trigger and firing mechanisms, grip, ammunition feeding system, barrel, and slide. For operably attaching the slide to the frame, the frame includes a set of rails positioned on opposite longitudinal sides of the frame. The rails are integral with the rest of the frame, i.e., the frame, including the rails, is machined or otherwise formed from a single piece of metal or other material.

In addition to the rails, the frame includes other integrally machined features for attaching, supporting, and/or guiding additional components of the firearm such as the trigger and firing mechanism sear. While such features (including the rails) function well from an operational standpoint, the manufacturing process for forming the rails and other integral features can be time consuming and complex.

SUMMARY OF THE INVENTION

According to an embodiment of a firearm with modular sear and trigger mechanism housings of the present invention, a firearm includes a firearm frame and a modular housing. The frame has at least one receptacle formed therein, with the modular housing being removably received in the receptacle. For example, the receptacle may be an upwardly open compartment integral with the frame and accessible from the top of the frame, and the modular housing may be configured for "drop-in" insertion into the compartment. The modular housing is configured for accommodating one or more operational components of the firearm, e.g., triggers, trigger bar, sear assemblies, or the like. (By "accommodating," it is meant that one or more firearm components may be operably attached to and/or housed in the modular housing.) In operation, the operational components are attached to the modular housing, the modular housing is dropped into receptacle, and the modular housing is secured in place.

In another embodiment, the modular housing is provided with a set of slide rails. The slide rails partially or wholly replace the rails typically integrally formed on a firearm frame. A slide portion of the firearm moves along the slides in a reciprocating manner during operation of the firearm.

In another embodiment, the frame has fore and rear receptacles formed therein. A modular trigger mechanism housing is disposed in the fore receptacle, and has one or more trigger mechanism components attached thereto. A modular sear mechanism housing is disposed in the rear receptacle for housing a sear mechanism. Each modular housing includes a set of slide rails.

One advantage of the firearm with modular sear and trigger mechanism housings according to an embodiment of the present invention is that it utilizes a "generic" frame provided without integral rails and other features for supporting the firing mechanism or other operational components. Instead, the rails are provided as part of the modular, drop-in sear and trigger mechanism housings configured to support the trigger and firing mechanisms. During assembly, the modular sear and trigger housings are simply inserted into the frame, at appropriate pre-configured locations, and are secured in place.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
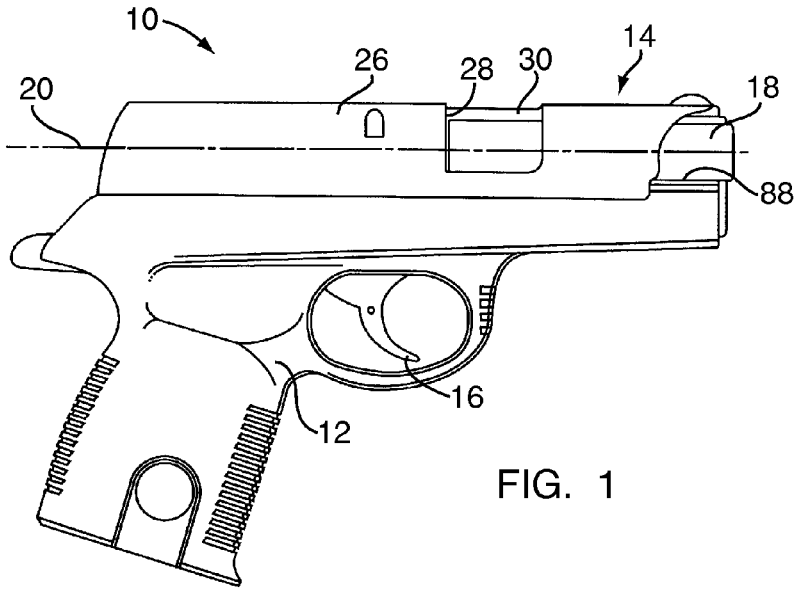
FIG. 1 is a simplified schematic side view of a semiautomatic pistol.
Figure 2:
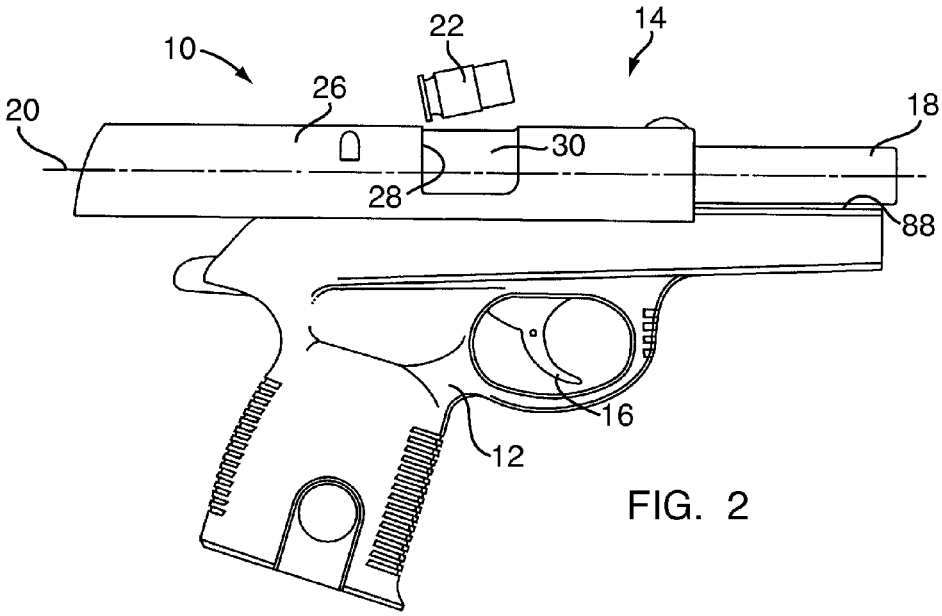
FIG. 2 is a simplified schematic side elevation view of the pistol of FIG. 1 shown with the slide moved to a rearward position on the pistol frame.

Referring to FIGS. 1 and 2, one exemplary embodiment of a semiautomatic pistol or firearm with modular sear and trigger mechanism housings of the present invention is shown generally at 10 and is hereinafter referred to as "firearm 10." The firearm 10 comprises a frame 12, a slide 14, and a fire control mechanism that operates via actuation of a trigger 16. The frame 12 is fabricated of a high-impact polymer material, metal, or a combination of polymer and metal. The slide 14 houses a barrel 18 in the forward end thereof. The barrel 18 is cooperatively linked with the slide 14 and, together with the slide 14, defines a longitudinal firing axis 20. A rearward end of the barrel 18 is adapted for receiving an ammunition cartridge 22.

The slide 14, which is defined by a slide frame 26, further includes a breech face 28 and an extractor port 30. The breech face 28 is engagable with the rearward end of the barrel 18 to form a firing chamber when the slide 14 is disposed forwardly on the frame 12 (FIG. 1). An ejection mechanism provides for the ejection of a cartridge casing 22 upon firing the firearm 10 or manually cycling the slide 14.

Figure 3:
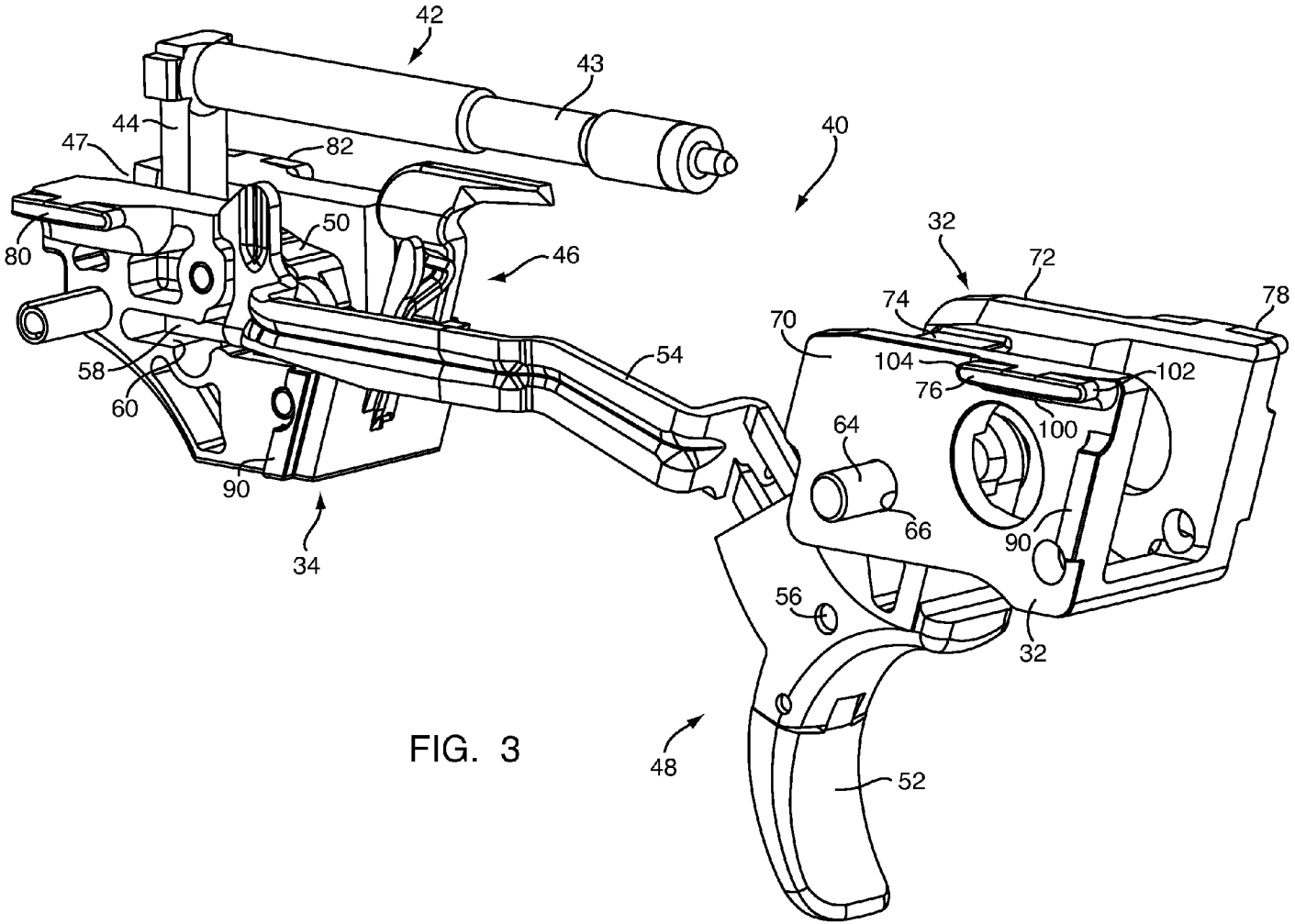
FIG. 3 is a simplified schematic perspective view of trigger and sear housing portions of a semiautomatic pistol according to an embodiment of the present invention.

Referring now to FIG. 3, the firearm 10 further comprises a trigger mechanism housing 32 and a sear housing or sear block 34. The trigger mechanism housing 32 and sear housing 34 together support portions of a fire control mechanism generally shown at 40. The fire control mechanism 40 is of a striker-type configuration and comprises a striker-type firing pin 42 having a firing pin portion 43 and a depending leg 44. The fire control mechanism further includes a sear assembly 46 and a trigger assembly 48. The sear assembly 46 has a pivotally mounted sear 50 that engages the firing pin 42. The trigger assembly 48, which functions to actuate the sear 50, includes a trigger 52 pivotally connected to the trigger mechanism housing 32, and a trigger bar 54 pivotally connected to the trigger 52 via a pin 56. The trigger bar 54 connects the trigger 52 and the sear assembly 46. A trigger bar extension 58 extends from the trigger bar 54 into a channel 60 of the sear housing 34. The trigger 52 may be of unitary construction, as shown, or of a multiple-piece articulated construction.

When the trigger 52 is actuated by being pressed in a rearward direction, the trigger 52 pivots about a pin 64 that extends through a lateral opening 66 in the trigger mechanism housing 32. This transmits movement to the trigger bar 54 via the pin 56. The trigger bar 54 is thereby moved in a rearward direction substantially parallel to the longitudinal firing axis 20 such that the trigger bar extension 58 correspondingly translates in the channel 60, for actuation of the sear 50.

The trigger mechanism housing 32 is a generally open frame-like support having first and second sidewalls 70, 72 interconnected by one or more lateral cross members 74. The sidewalls 70, 72 are provided with various laterally aligning openings, e.g., the lateral opening 66, for attachment of various subcomponents and/or for attachment of the trigger mechanism housing 32 to the frame 12. As noted, the interior of the trigger mechanism housing 32 is generally open, to accommodate the trigger 52 as well as any other components configured for disposition between the two sidewalls 70, 72.

Figure 4:
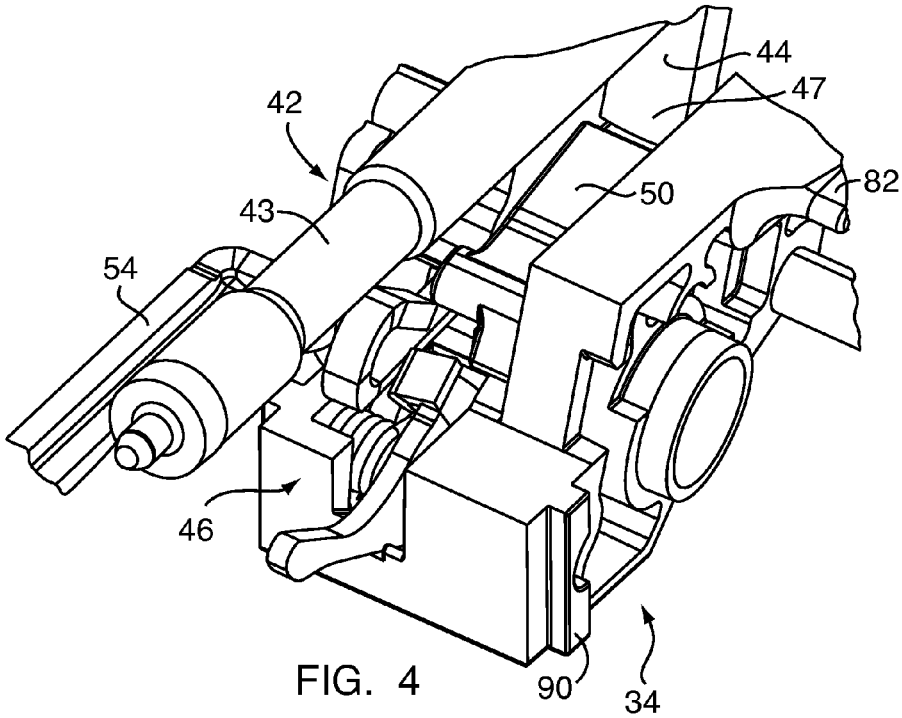
FIGS. 4 and 5 are detail perspective views of the sear housing (sear block)
Figure 5:
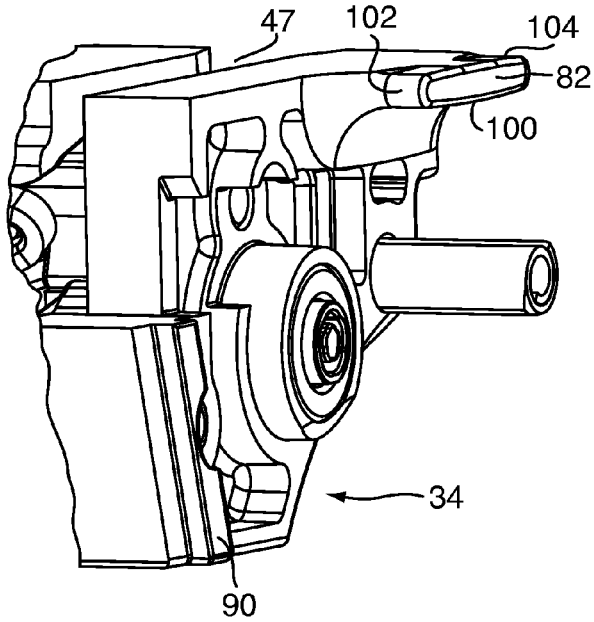

The sear housing 34 is a generally solid body having a number of openings, slots, etc. formed therein for accommodating the various components of the sear assembly 46. Detailed views of the sear housing 34 are shown in FIGS. 3-5. The particular number of openings and slots in the sear housing 34, and their dimensions/configurations, will depend on the particular nature and configuration of the sear assembly components, which, of course, will depend on the type of sear assembly utilized. For example, as shown in FIG. 3, the sear housing 34 may have a longitudinal slot 47 formed therein for accommodating the sear 50 as well as the passage of the depending leg 44 of the firing pin 42. The present invention can be adapted for use with different types of firing mechanisms, and is not meant to be limited to a particular type of firing mechanism.

For reciprocal movement of the slide 14 along the longitudinal firing axis 20, the trigger mechanism housing 32 has a pair of forward slide rails 76, 78 respectively attached to, and extending laterally outwards from, the upper side edges of the sidewalls 70, 72. Additionally, the sear housing 34 has a pair of rear slide rails 80, 82 similarly attached to, and extending laterally outwards from, opposite upper side edges of the sear housing 34. The slide rails 76, 78, 80, 82 are substantially identical in shape, and are dimensioned to fit within opposed, inwardly opening and longitudinally extending grooves (not shown) located on the inner surface of the slide 14. The slide rails may have arcuate, convex bottom surfaces 100 and/or chamfered or rounded leading and trailing edges 102, 104, respectively, to prevent the slide 14, upon discharge of the firearm 10, from the possibility of binding or overstressing the housings 32, 34. As should be appreciated, the slide rails 76, 78, 80, 82 are meant to fully or partially replace the rails previously integrally formed as part of the frame 12.

The trigger mechanism housing 32 and sear housing 34 may be manufactured using standard methods such as machining or molding, in which case the slide rails are integrally formed as part of the housings 32, 34. Alternatively, the housings 32, 34 may be assembled from various subcomponents attached together using standard means such as welding, adhesives, or fasteners. The housings 32, 34 may be made of various materials, but will typically be composed of a light, high-strength metal or metal alloy.

Figure 6:
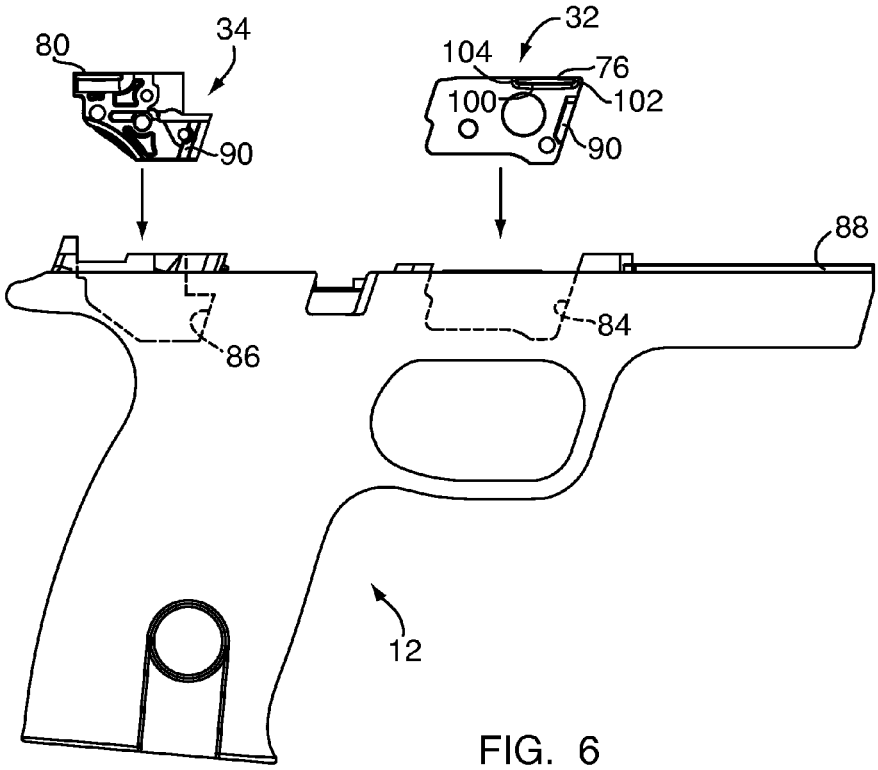
FIG. 6 is a simplified schematic view of the semiautomatic pistol of the present invention.

FIG. 6 schematically illustrates the manner in which the housings 32, 34 are attached to the frame 12. As indicated, the trigger mechanism housing 32 and sear housing 34 are configured for "drop in" insertion into the frame 12, which has forward and rear receptacles 84, 86 dimensioned to securely receive the housings 32, 34, respectively. The receptacles 84, 86 are interior, upwardly open compartments or receptacles integrally formed as part of the frame 12 during manufacturing, and are respectively complementary in shape to the housings 32, 34. Once inserted into the receptacles 84, 86, the housings 32, 34 are attached to the frame 12 using adhesives, welds, press or friction fit, or pins or the like (not shown). Typically, the trigger assembly 48 and sear assembly 46 will be attached to the housings 32, 34, respectively, prior to insertion of the housings 32, 34 into the frame 12. Additionally, the receptacles 84, 86 may be provided with angled or vertically oriented slots (not shown) for receiving tabs 90 on the sides of the housings 32, 34 (see FIGS. 3-5), for purposes of easily aligning the housings 32, 34 with respect to the receptacles and frame for assembly.

Once inserted into and attached to the frame 12, the housings 32, 34 lie in operative alignment with one another, such that: (i) the trigger bar 54 may be connected to the sear assembly 46; and (ii) the fore slide rails 76, 78 respectively align with the rear slide rails 80, 82. Additionally, the frame 12 may be provided with lead rails 88 on either side of the fore/barrel end of the frame 12, for further guidance of the slide 14. In that case, the rails 76, 78, 80, 82, 88 would all respectively align with one another for movement of the slide 14. In particular, the rails 76, 78, 80, 82, 88 would extend along the underside of the slide 14 in the longitudinal direction to allow for cycling of the slide 14 between forward (battery) and rearward (retired) positions.

With the housings 32,34 provided as separate, modular components for attachment to the frame 12, it is no longer necessary to machine or otherwise form the various component features of the housings 32, 34 as part of the frame 12 during the manufacturing process. Accordingly, the overall design and manufacturing process is rendered more efficient, more flexible (e.g., the possibility of different configurations and/or different materials for the frame 12 and housings 32, 34), and with less potential waste from manufacturing errors. Additionally, because the trigger and sear mechanism subcomponents can be attached to the housings prior to attaching the housings to the frame, the assembly process is simplified.

As should be appreciated, the receptacles 84, 86 and housings 32, 34 may be together characterized as "modular housing means" cooperative with the frame 12 for removably supporting one or more operational components of the firearm (e.g., the housings support the operational components and can be inserted into and removed from the receptacles) and for supporting the slide 14 in a reciprocating manner.

An additional embodiment of the present invention may be characterized as a modular firearm system having one or more firearm frames 12 and one or more separate housings, e.g., 32, 34, for holding, supporting, and/or guiding portions of a firearm operational mechanism. Each frame 12 has one or more receptacles for receiving the housings. The frames and housings are interchangeable, meaning that each frame accommodates all or some of the housings. Some of the receptacles may be configured to only accept one subset of the housings, e.g., if the frame has two receptacles, the first receptacle may be configured to accept one subgroup of housings and the second receptacle another subgroup of housings.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. A firearm comprising:

a frame having at least one interior receptacle defined by opposed interior walls, said interior receptacle having a main cavity having a first width and a guide cavity having a second width, said first width and said second width being of different dimension;

at least one modular housing disposed in said at least one receptacle and accommodating at least one operational component of the firearm;

wherein the at least one modular housing comprises a body portion and a set of slide rails attached to the body portion, said slide rails being configured for reciprocating movement of a slide portion of the firearm thereon;

an engagement means extending outwardly from said at least one modular housing, said engagement means being configured to selectively engage with said guide cavity to facilitate the aligning of said at least one modular housing with respect to said interior receptacle; and wherein the at least one operational component and the modular housing, including the body portion and set of slide rails, are pre-assembled together as an integrated unit for drop-in insertion into the receptacle during assembly of the firearm.

2. The firearm of claim 1 wherein the body portion of the modular housing comprises first and second sidewalls and at least one lateral cross member, said sidewalls being spaced apart and generally parallel to one another, and said sidewalls being interconnected by the at least one lateral cross member, and wherein a first of said set of slide rails is attached to the first sidewall and a second of said set of slide rails is attached to the second sidewall, and wherein the body portion and the slide rails are integrally formed together.

3. A firearm comprising:

a frame having at least one receptacle; and at least one modular housing disposed in said at least one receptacle and accommodating at least one operational component of the firearm, wherein the at least one modular housing comprises a body portion and a set of slide rails attached to the body portion, said slide rails being configured for reciprocating movement of a slide portion of the firearm thereon, wherein the at least one operational component and the modular housing, including the body portion and set of slide rails, are pre-assembled together as an integrated unit for drop-in insertion into the receptacle during assembly of the firearm, wherein the at least one receptacle comprises a fore receptacle and a rear receptacle; and the at least one modular housing comprises a modular trigger housing removably received in the fore receptacle and a modular sear housing removably received in the rear receptacle, wherein the modular trigger housing accommodates at least one trigger mechanism component of the firearm, said modular trigger housing and said at least one trigger mechanism component being pre-assembled together as an integrated unit for drop-in insertion into the fore receptacle, and wherein the modular sear housing accommodates at least one sear mechanism component of the firearm, said modular sear housing and said at least one sear mechanism component being pre-assembled together as an integrated unit for drop-in insertion into the rear receptacle.

4. The firearm of claim 3 wherein:

the trigger housing and sear housing each include at least one tab on a side of the housing; and the fore and rear receptacles each include at least one slot dimensioned to accommodate said at least one tab, whereby the trigger and sear housings may be easily aligned with the fore and rear receptacles for ease of assembly.

5. The firearm of claim 3 wherein:

the trigger housing comprises a first body portion and a first set of slide rails attached to the first body portion; and the sear housing comprises a second body portion and a second set of slide rails attached to the second body portion; wherein the first and second sets of slide rails operatively align for reciprocating movement of a slide portion of the firearm thereon.

6. The firearm of claim 5 wherein:

the trigger housing body portion comprises first and second sidewalls interconnected by at least one lateral cross member;

the firearm further comprises a trigger pivotally attached to the trigger housing and disposed in a space defined between the first and second sidewalls of the trigger housing, and wherein the first set of side rails and the trigger housing body portion, including the sidewalls and the at least one lateral cross member, are integrally formed together.

7. The firearm of claim 5 wherein the frame further comprises a lead set of slide rails positioned at a fore end of the frame and operatively aligned with the first and second sets of slide rails for reciprocating movement of the slide portion of the firearm thereon.

8. A modular housing for a firearm component comprising:

a body portion accommodating at least one operational component of the firearm, said body portion being dimensioned for insertion into a complementary shaped frame receptacle;

a set of slide rails attached to the body portion, said slide rails being configured for reciprocating movement of a firearm slide thereon;

wherein the body portion and the set of slide rails are pre-assembled together as an integrated unit for drop-in insertion into the receptacle during assembly of the firearm;

wherein said frame receptacle is an interior receptacle defined by opposed interior walls, said interior receptacle having a main cavity having a first width and a guide cavity having a second width, said first width and said second width being of different dimension; and an engagement means extending outwardly from said at least one modular housing, said engagement means being configured to selectively engage with said guide cavity to facilitate the aligning of said at least one modular housing with respect to said interior receptacle.

9. The modular housing of claim 8 further comprising:

at least one alignment tab attached to the body portion and dimensioned for insertion into at least one slot portion of the frame receptacle.

10. The modular housing of claim 8 wherein the body portion comprises first and second spaced apart, generally parallel sidewalls interconnected by at least one lateral cross member, said first and second sidewalls defining a space therebetween dimensioned to accommodate a firearm trigger, and wherein the side rails and the body portion, including the sidewalls and at least one lateral cross member, are integrally formed together.

11. The modular housing of claim 8 wherein the body portion has a longitudinal channel formed therein, said channel being dimensioned to accommodate a pivotal sear and the passage of a depending leg portion of a striker firing pin, and wherein the body portion and the slide rails are integrally formed together.

12. The modular housing of claim 8 wherein each slide rail has an arcuate, convex bottom surface and chamfered leading and trailing edges for facilitating passage of the firearm slide.

13. A modular housing system for firearm components, said system comprising:

a frame having a first receptacle; and a first plurality of modular housings each differently configured for accommodating one or more firearm operational components, wherein each of said first plurality of modular housings has outer dimensions configured for secure removable insertion into said first receptacle, and wherein each of said plurality of modular housings includes a body portion and a set of slide rails attached to the body portion for reciprocating movement of a slide portion of a firearm thereon, said body portion and said set of slide rails being pre-assembled together as an integrated unit for drop-in insertion into the first receptacle during assembly of the firearm, wherein said frame further comprises a second receptacle; and wherein said system further comprises a second plurality of modular housings each differently configured for accommodating one or more firearm operational components, wherein each of said second plurality of modular housings has outer dimensions configured for secure removable insertion into said second receptacle, and wherein each of said second plurality of modular housings includes a body portion and a set of slide rails attached to the body portion for reciprocating movement of a slide portion of a firearm thereon, said body portion and said set of slide rails being pre-assembled together as an integrated unit for drop-in insertion into the second receptacle during assembly of the firearm.

* * * * *